United States Patent [19]

Tucker et al.

[11] Patent Number: 4,984,995

[45] Date of Patent: Jan. 15, 1991

[54] ANTI-DECOUPLING DEVICE FOR ELECTRICAL CONDUIT CONNECTOR

[75] Inventors: Willy L. Tucker; Katherine M. Arcoleo, both of San Jose, Calif.

[73] Assignee: Icore International, Inc., Sunnyvale, Calif.

[21] Appl. No.: 434,199

[22] Filed: Nov. 13, 1989

[51] Int. Cl.[5] ..... H01R 13/639

[52] U.S. Cl. ..... 439/321; 285/81; 403/328; 439/470

[58] Field of Search ..... 439/321, 348, 470; 285/81, 82; 411/7, 348, 911; 403/328

[56] References Cited

U.S. PATENT DOCUMENTS

| | | | |
|---|---|---|---|
| 1,540,374 | 6/1925 | Stevens | 285/92 |
| 3,343,852 | 9/1967 | Blight et al. | 439/348 |
| 3,601,764 | 8/1971 | Cameron | 439/321 |
| 4,030,798 | 6/1977 | Paoli | 439/321 |
| 4,152,039 | 5/1979 | Shah | 439/321 |
| 4,239,315 | 12/1980 | Lacaze, Jr. | 439/348 |
| 4,272,087 | 6/1981 | Rohm | 403/328 |
| 4,834,667 | 5/1989 | Fowler et al. | 439/321 |
| 4,863,396 | 9/1989 | Johnson | 439/470 |
| 4,869,687 | 9/1989 | Johnson | 439/470 |

OTHER PUBLICATIONS

Facsimile copy of Admitted Prior Art Connector Assembly, received on Mar. 8, 1990.

*Primary Examiner*—Gary F. Paumen
*Attorney, Agent, or Firm*—Townsend and Townsend

[57] ABSTRACT

An assembly which prevents a nut carried by an electrical conduit from decoupling from a connector. The inner periphery of the nut near the rear end teeth which define a pair of surface portions between each pair of adjacent teeth. An adapter has a spring biased detent adapted to be received in the space between an adjacent pair of teeth or in engagement with one of the surface portions. The first surface portion of each pair of teeth extends at a relatively steep angle away from the inner periphery of the nut, and a second surface portion extends at a relatively shallow angle away from such inner periphery. When each detent is in a first position adjacent to the steep surface portions, a relatively large force is required to rotate the nut in one direction past the adjacent tooth against the bias force of the spring urging the detent into the respective space; whereas, a relatively small force is required to rotate the nut in the opposite direction as the detent is moved from the first position, at which it is normally located, past the adjacent shallow surface portion and past the next adjacent tooth. The rotation of the nut in one direction corresponds to the loosening of the nut, and the rotation of the nut in the opposite direction corresponds to the tightening of the nut.

2 Claims, 2 Drawing Sheets

ANTI-DECOUPLING DEVICE FOR ELECTRICAL CONDUIT CONNECTOR

FIELD OF THE INVENTION

This invention relates to improvements in the connecting of flexible electrical conduit to Mil-spec.-type electrical connectors and, more particularly, to a device for preventing the decoupling of a conduit to a connector of the above type to thereby assure a safe, reliable connection at all times.

BACKGROUND OF THE INVENTION

To couple a flexible electrical conduit to a Mil-spec.-type circular electrical connector requires that a rotatable nut on the end of the conduit be threadably coupled to the external threads of the electrical connector to thereby hold the conduit coupled to the connector. In many instances, the nut, for one or more reasons, such as vibration, is caused to become unthreaded or loosened from the connector itself. This causes the connection to become faulty and the resulting loss of power or signal to vital components in an electrical system associated with the connector.

Attempts have been made in the past to avoid this problem of decoupling the nut from the connector but such attempts have resulted in the addition of structural features which are complex or work only for a short time and add considerably to the overall cost of the system. For example, a lock wire has been used to secure the nut in place, but the wire must be broken to separate the nut from the connector. Also, nylon inserts have been used on the threads of the nut but such inserts are good for only a single use.

Thus, a need continues to exist for improvements in the proper retention of the nut on the connector. The present invention provides an improvement which satisfies this need.

SUMMARY OF THE INVENTION

The present invention is directed to an assembly which prevents a nut carried by an electrical conduit from decoupling from a connector, such as a Mil-spec.-type electrical connector. To this end, the assembly includes a nut and an adapter which couples the conduit to the nut. The inner periphery of the nut near the rear end of the nut is provided with spaced teeth which define a pair of surface portions between each pair of adjacent teeth. The adapter carries one or more spring biased detents at several locations on the outer periphery thereof and each detent is adapted to be received in the space between an adjacent pair of teeth or in engagement with one of the surface portions.

The space between each pair of adjacent teeth has a first surface portion which extends at a relatively steep angle away from the inner periphery of the nut and a second surface portion which extends at a relatively shallow angle away from such inner periphery. When each detent is in a first position adjacent to the steep surface portions, a relatively large force is required to rotate the nut in one direction past the adjacent tooth against the bias force of the spring urging the detent into the respective space; whereas, a relatively small force is required to rotate the nut in the opposite direction as the detent is moved from the first position, at which it is normally located, past the adjacent shallow surface portion and past the next adjacent tooth. The rotation of the nut in one direction corresponds to the loosening of the nut, and the rotation of the nut in the opposite direction corresponds to the tightening of the nut. Thus, it is much more difficult to loosen the nut than it is to tighten the nut.

The relatively large force required in said one direction provides an anti-decoupling feature for the connector system so that, once the nut is threaded onto a connector by rotating the nut relatively easily in the aforesaid opposite direction, the nut is prevented substantially from being loosened or rotated in the aforesaid one direction without a relatively large force exerted on the nut. The nut is, therefore, safely and reliably coupled to the connector and requires either strong hand power or a tool to rotate the nut in the one direction.

The primary object of the present invention is to provide an anti-decoupling assembly for use with a conduit connector unit wherein the assembly includes a nut having an inner periphery provided with spaced teeth thereon and an adapter for carrying one or more detents to be removably received in the spaces between the teeth, whereby the nut can be rotated in one direction with a relatively small force to thread the nut on a connector but the nut must be rotated with a relatively large force to rotate the nut in the opposite sense to prevent the nut from being unthreaded from the connector to thereby provide a safe, reliable attachment of the conduit to the connector once the nut has been threaded onto the connector.

Other objects of the present invention will become apparent as the following specification progresses, reference being had to the accompanying drawings for an illustration of the invention.

DETAILED DESCRIPTION OF THE EMBODIMENT

Figures 1, 2, 3:
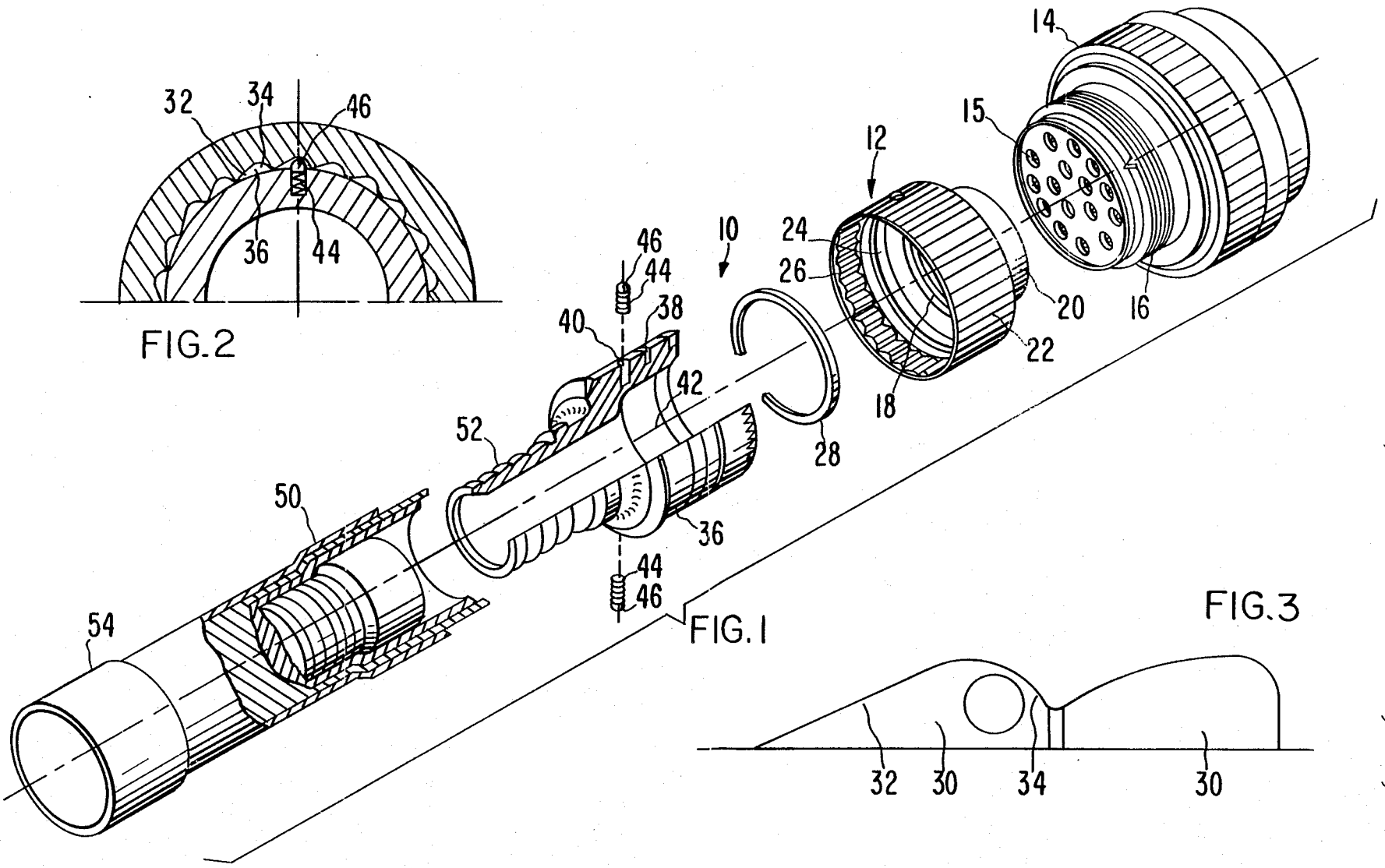
FIG. 1 is an exploded view of a cable connector assembly showing a nut, a retention ring, and an adapter for coupling a flexible electrical conduit to a Mil-spec.-type electrical connector.
FIG. 2 is a semi-circular, vertical section through the nut and the adapter.
FIG. 3 is an enlarged schematic view of the space between a pair of ratchet teeth carried by the nut and showing the relatively steep and the relatively shallow surface portions of the nut between the teeth.

The anti-decoupling assembly of the present invention is broadly denoted by the numeral 10 and is adapted to form a part of a connector unit 12 including a circular electrical connector 14 which is made to the requirements of Mil-specs. Such a connector may be one identified as M5015 or M26482, but is not limited to these. Connector 14 has an externally threaded, axially extending end part 16 which is adapted to be threadably coupled to the threads 18 on sleeve 20 of a coupling nut 22.

Nut 22 has an annular, internal slot 24 between threads 18 and a series of circumferentially spaced ratchet teeth 26. The slot 24 is adapted to receive a split ring 28 which is of resilient spring steel or the like. Teeth 26 extend axially of nut 22 and are separated from each other by a recess 30 (FIGS. 2 and 3). Each recess 30 has a relatively shallow surface portion 32 and a relatively steep surface portion 34 in the space between each pair of adjacent teeth 26.

A connector adapter 36 of cylindrical configuration has an outer peripheral, annular slot 38 therein for receiving split ring 28 at the inner peripheral margin thereof, the ring projecting outwardly from slot 38 and into slot 24 of nut 22. Thus, the ring 28 rotatably couples nut 22 to adapter 26.

Adapter 36 has two diametrically opposed recesses or bores 40 therein which are radial with respect to the central axis 42 of adapter 36. Each recess or bore 40 receives a coil spring 44 and a detent, such as a steel ball 46, as shown in FIG. 2. The pair of steel balls 46 are adapted to normally nest in respective recesses 30 to thereby prevent nut 22 from rotating about adapter 36 without sufficient torque being applied.

It is easy to rotate nut 22 in a clockwise direction, the direction of tightening of the nut, when viewing FIGS. 2 and 3 because of the shallowness of surface portions 32, but it is extremely difficult to rotate nut 22 in a counterclockwise sense, the direction of loosening of the nut, when viewing FIGS. 2 and 3 because of the steepness of surface portions 34. Thus, the nut, once it is threaded onto connector 14, cannot easily be decoupled from the connector because of the steepness of the angle of surface portions 34. The structure of the present invention is designed in such a way that the force required to decouple nut 22 from connector 14 is much greater than the force required to couple the nut to the connector. It may be possible to vary the design of the present invention so as to make it impossible to decouple the nut from the connector.

A flexible electrical conduit 50 is adapted to be coupled to barbs 52 of an adapter 36. A swage sleeve 54 copules conduit 50 to adapter 36 which is to be coupled to connector 14.

In use, a flexible electrical conduit 50 is carried by sleeve 54, and the electrical leads (not shown) of the conduit pass through adapter 36 and through coupling nut 22. The coupling nut is then threadably mounted on connector 14. As the nut rotates in a clockwise sense when viewing FIGS. 2 and 3, relatively shallow surfaces 32 rise smoothly and easily over ball 46 until nut 22 is tightened on the threads 16 of connector 14. Then, the conduit is coupled to the connector and the conduit may have pins which enter the end holes 15 of connector 14.

The nut 22 and teeth 26 cannot be rotated without a large force in a counterclockwise sense when viewing FIGS. 2 and 3 because of the relatively steep angle of surface portions 34. As shown in FIG. 3, each surface portion 34 is curved substantially complemental to the curvature of balls 46 so it takes a much greater force to rotate nut 22 in the counterclockwise sense when viewing FIGS. 2 and 3 than is required to rotate the nut in a clockwise sense. Thus, the nut, adapter and detent means serve as an anti-decoupling unit or device suitable for terminating a flexible electrical conduit to Mil-spec.-type circular connectors, such as connector 14.

We claim:

1. An anti-decoupling unit for coupling a flexible electrical conduit to a connector having a threaded part, comprising:

a nut adapted to be threaded onto the threaded part of the connector, said nut having an inner periphery provided with a plurality of spaced recesses thereon, each recess including a relatively steep surface portion and a relatively shallow surface portion connected to the relatively steep surface portion; and an adapter having means for coupling the adapter to the nut, said adapter having an outer periphery and a radial bore extending thereinto from said outer periphery, there being means for mounting an electrical conduit on said adapter when the conduit is to be coupled to the connector;

a ball;

a coil spring, said ball and spring being in said bore with the spring being under compression for biasing the ball outwardly of the bore and into an adjacent said recess of the nut when the nut is coupled with the adapter, said ball being engageable with one of the surface portions of a said recess, the steepness and shallowness of the surface portions being sufficient to cause a relatively large force to be required to rotate the nut in one direction and to cause a relatively small force to be required to rotate the nut in the opposite direction.

2. A unit as set forth in claim 1, wherein the nut has a plurality of spaced teeth on said inner periphery thereof, each pair of adjacent teeth having a recess therebetween.

* * * * *